US007318708B2

(12) United States Patent
Dolson

(10) Patent No.: US 7,318,708 B2
(45) Date of Patent: Jan. 15, 2008

(54) CHECK VALVE FOR A SUBMERSIBLE TURBINE PUMP

(75) Inventor: Richard Dolson, Collinsville, CT (US)

(73) Assignee: Veeder-Root Company, Simsbury, CT (US)

( * ) Notice: Subject to any disclaimer, the term of this patent is extended or adjusted under 35 U.S.C. 154(b) by 331 days.

(21) Appl. No.: 10/959,899

(22) Filed: Oct. 6, 2004

(65) Prior Publication Data

US 2005/0100460 A1 May 12, 2005

Related U.S. Application Data

(60) Provisional application No. 60/510,735, filed on Oct. 11, 2003.

(51) Int. Cl.
*F04B 17/00* (2006.01)

(52) U.S. Cl. ..... 417/423.3; 417/422

(58) Field of Classification Search ..... 417/423.3, 417/422, 454, 73, 569, 570, 559; 137/614.17, 137/614.21, 614.2

See application file for complete search history.

(56) References Cited

U.S. PATENT DOCUMENTS

| | | | | |
|---|---|---|---|---|
| 2,634,752 | A | 4/1953 | Bertea | 137/630.13 |
| 2,952,247 | A | 9/1960 | Swanson | 121/46.5 |
| 3,172,572 | A * | 3/1965 | Brown et al. | 222/109 |
| 5,544,518 | A | 8/1996 | Hart et al. | 73/1 H |
| 6,223,765 | B1 | 5/2001 | Small et al. | 137/312 |
| 6,834,534 | B2 | 12/2004 | Halla et al. | 73/49.2 |
| 2004/0045343 | A1 | 3/2004 | Hutchinson | 73/40.5 |

FOREIGN PATENT DOCUMENTS

| | | |
|---|---|---|
| GB | 577938 | 6/1946 |

* cited by examiner

*Primary Examiner*—Anthony Stashick
*Assistant Examiner*—Vikansha Dwivedi
(74) *Attorney, Agent, or Firm*—Nelson Mullins Riley & Scarborough LLP

(57) ABSTRACT

The present invention provides a submersible turbine pump (STP) comprising a check valve located within a hydraulics cavity, wherein the STP provides the ability to depressurize the hydraulics cavity by relieving a pressure differential between an inlet side and an outlet side of the check valve. In general, the STP is comprised of a casing body comprising a check valve extraction housing and the hydraulics cavity. The check valve is located within the hydraulics cavity and is comprised of a check valve stem, an inlet side, and an outlet side. The check valve extraction housing comprises a lock-down screw adapted to attach to the check valve stem and apply a force to the check valve to open the check valve, thereby relieving the pressure differential between the inlet side and the outlet side.

17 Claims, 13 Drawing Sheets

CHECK VALVE FOR A SUBMERSIBLE TURBINE PUMP

RELATED APPLICATION

This application claims priority to Provisional Patent Application Ser. No. 60/510,735 filed on Oct. 11, 2003, which is hereby incorporated by reference in its entirety.

This application is related to the following commonly owned U.S. Patent Applications, which are hereby incorporated by reference in their entireties:

i) U.S. patent application Ser. No. 10/959,869, entitled "Spring Loaded Submersible Turbine Pump", filed on Oct. 6, 2004, ii) U.S. patent application Ser. No. 10/959,412, entitled "Yoke Assembly For A Submersible Turbine Pump That Pumps Fuel From An Underground Storage Tank", filed on Oct. 6, 2004, iii) U.S. patent application Ser. No. 10/959,705, entitled "Integral Contractors Box For A Submersible Turbine Pump", filed on Oct. 6, 2004, and iv) U.S. patent application Ser. No. 10/959,415, entitled "Siphon System For A Submersible Turbine Pump That Pumps Fuel From An Underground Storage Tank", filed on Oct. 6, 2004.

FIELD OF THE INVENTION

The present invention relates to a submersible turbine pump, and more particularly to a check valve and relief system for a submersible turbine pump.

BACKGROUND OF THE INVENTION

In service station environments, fuel is delivered to fuel dispensers from underground storage tanks (UST), sometimes referred to as fuel storage tanks. USTs are large containers located beneath the ground that contain fuel. A separate UST is provided for each fuel type, such as low octane gasoline, high-octane gasoline, and diesel fuel. In order to deliver the fuel from the USTs to the fuel dispensers, a submersible turbine pump (STP) is provided that pumps fuel out of the UST and delivers the fuel to fuel dispensers through a main fuel piping conduit that runs beneath the ground in the service station.

A typical STP has a casing body that includes a top, also called a "packer," and a manifold. The packer fits on top of the manifold to form a tight seal when the STP is its normal configuration. If access to the internal chamber of the STP is required, the packer can be removed from the manifold. The STP also includes a check valve within a hydraulics cavity. As fuel is pumped into the STP, the fuel flow encounters the check valve, which allows fuel flow from an inlet side to an outlet side and prevents fuel from back flowing to the UST.

When the STP is serviced, the STP is shut off and the service personnel must remove the packer. However, after the STP is turned off, there is a differential pressure between the outlet side of the check valve and atmosphere. If the housing around the check valve is removed by service personnel to gain access to the check valve, the pressure build up on the outlet side of the check valve will equalize with atmosphere and fuel will possibly spill outside of the STP and onto the service personnel and/or the environment. Thus, there remains a need for the ability to depressurize the check valve before the check valve is serviced.

In addition, when testing the fuel supply piping for leaks, it is desirable to isolate the STP from the fuel supply piping. If a leak is detected after the STP is isolated from the fuel supply piping, then the STP can be eliminated as the source of the leak. Accordingly, there also remains a need for an STP that can easily be isolated from the fuel supply piping during testing.

SUMMARY OF THE INVENTION

The present invention provides a submersible turbine pump (STP) comprising a check valve located within a hydraulics cavity. The STP provides the ability to depressurize the hydraulics cavity by relieving a pressure differential between an inlet side and an outlet side of the check valve.

In general, the STP is comprised of a casing body comprising a check valve extraction housing and the hydraulics cavity. The check valve is located within the hydraulics cavity and is comprised of a check valve stem, an inlet side, and an outlet side. The check valve extraction housing comprises a lock-down screw that is rotated to attach to the check valve stem. Once attached to the check-valve stem, the lock-down screw is rotated to apply a force to the check valve to open the check valve, thereby relieving the pressure differential between the inlet side and the outlet side. In one embodiment, the lock-down screw is rotated in a forward direction to attach to the check valve stem and in a reverse direction to apply a force on the check valve to open the check valve.

The lock-down screw may also include a c-spring. When the lock-down screw engages the check valve stem, the force of the c-spring is released, thereby coupling the lock-down screw to the check valve stem.

The present invention may also be used to isolate a submersible turbine pump from fuel supply piping when testing the fuel supply piping for leaks. Once the check valve extraction housing is attached to the check-valve stem, the lock-down screw applies a force on the check valve stem and forces the check valve in a closed position as previously discussed above. By forcing the check valve in the closed position, the lock-down screw isolates the submersible turbine pump from the fuel supply piping. Thereafter, the fuel supply piping is pressurized and leaks can be detected by service personnel.

Those skilled in the art will appreciate the scope of the present invention and realize additional aspects thereof after reading the following detailed description of the invention in association with the accompanying drawing figures.

BRIEF DESCRIPTION OF THE DRAWINGS

The accompanying drawing figures incorporated in and forming a part of this specification illustrate several aspects of the invention, and together with the description serve to explain the principles of the invention.

DETAILED DESCRIPTION OF THE INVENTION

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
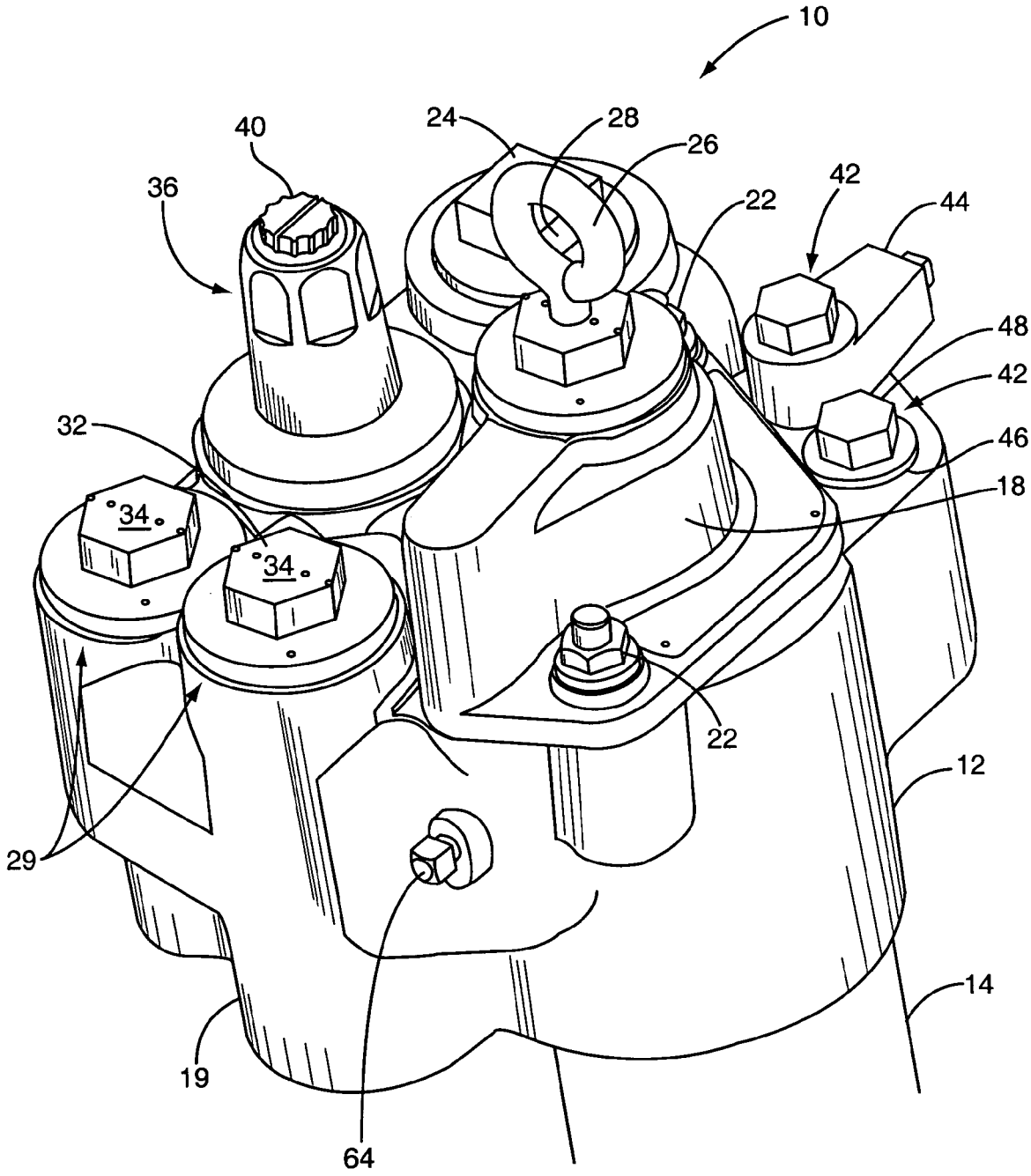
FIG. 1 is a schematic diagram of the submersible turbine pump (STP) according to the present invention.

FIG. 1 illustrates a submersible turbine pump (STP) 10 that embodies various inventive aspects that are the subject of this provisional patent application. The STP 10 is comprised of a casing that contains a body 12 which is generally cylindrical. A riser pipe 14 is coupled to the manifold 19. The riser pipe 14 is designed to be secured on the top of an underground storage tank (not shown), and contains fuel piping that carries fuel pumped by the STP 10 to be delivered to one or more fuel dispensers (not shown). The riser pipe 14 typically rests on the underground storage tank at the tank opening, and the weight of the casing body 12 and the components is borne by the underground storage tank. More information on the general operation of a STP 10 in a service station environment can be found in U.S. Pat. No. 6,223,765 B1, entitled "Casing Construction for Fuel Dispensing System," in FIGS. 3 and 10 in particular. U.S. Pat. No. 6,223,765 B1 is incorporated hereby by reference in its entirety.

Before describing the particular inventive aspects of the STP 10 contained in this patent application in detail, a continued overview of the various components of the STP 10 is illustrated in FIG. 1 follows.

The casing body 12 has a top 18, also called a "packer," that is normally closed. The casing body 12 is also comprised of a manifold 19. The packer 18 fits on top of the manifold 19 to form a tight seal when the STP 10 is its normal configuration. The packer 18 can be removed if the STP 10 needs to be serviced. If the STP 10 needs to be serviced by gaining access to the internal hydraulics cavity 20 (illustrated in FIG. 2) of the STP 10, the packer 18 is removed from the manifold 19. The packer 18 is secured to the casing 12 and manifold 19 [gs] by a plurality of fasteners, also called "nuts" 22 [gs for "nuts"] that fit into studs 23 (illustrated in FIG. 2) which are tightened down to secure the packer 18 to the manifold 19. Typically, the nuts 22 can be loosened by applying a socket or wrench to the nuts 22 and rotating the nuts 22 counterclockwise.

After the nuts 22 are loosened by rotating them counterclockwise, the packer 18 can be removed from the manifold 19 by applying a pulling force to a handle 24 that is secured to the packer 18. The handle 24 has a curly shaped head 26 that is designed to allow a rope or chain to be placed inside an orifice 28 formed by the head 26 to apply such force. When the packer 18 is placed on body 12 on top of the manifold 19 and the nuts 22 are tightened, the casing 12 is fluid tight. The packer 18 is removable so that access can be obtained to the internal hydraulics cavity 20 of the STP 10.

Figure 4:
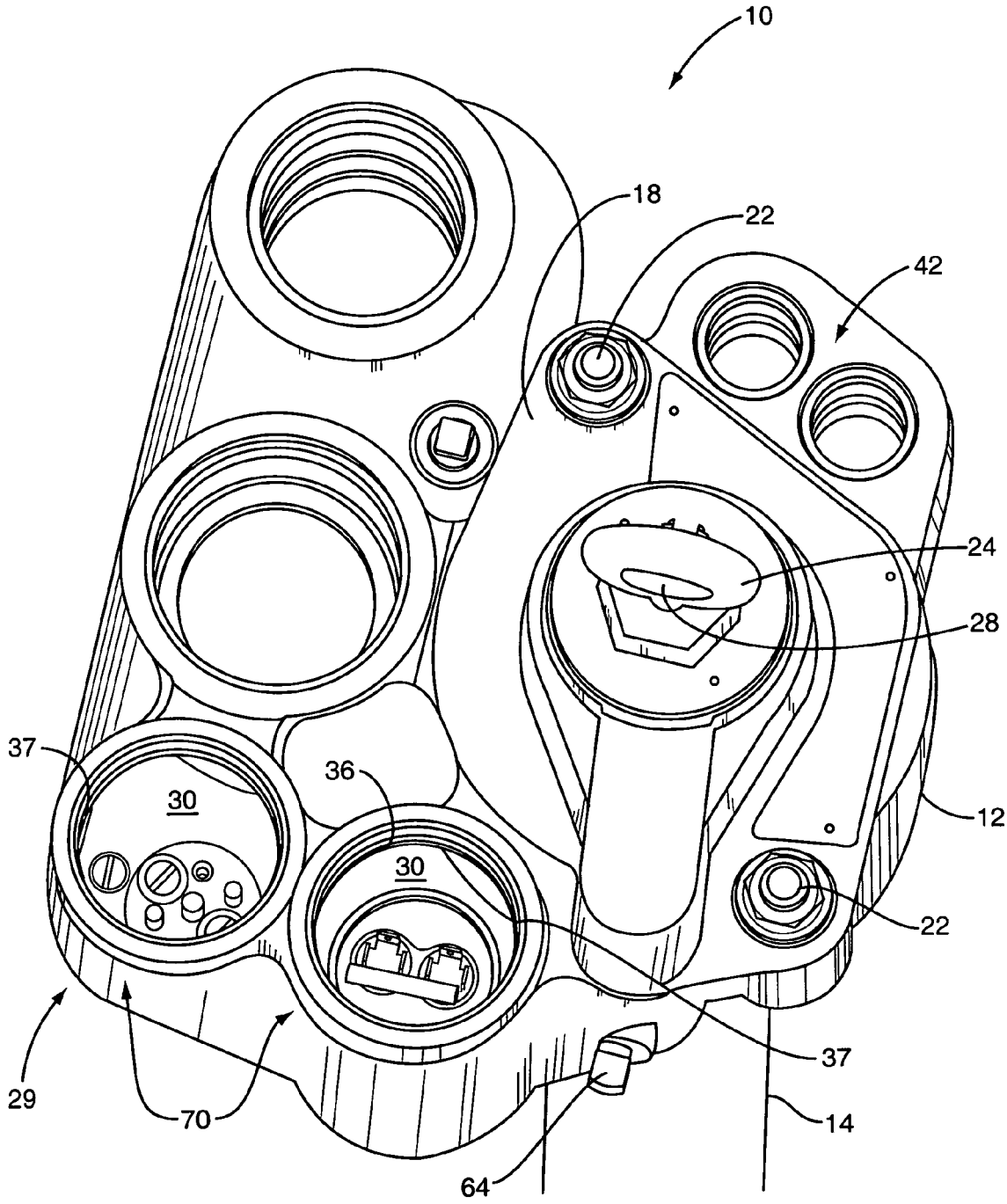
FIG. 4 is a schematic diagram of the STP illustrated in FIG. 1 with field wiring access electrical contractors boxes open and illustrated.

The manifold 19 contains an integral contractors box 29 that allow a service personnel to gain access to electrical cavity 30 (illustrated in FIGS. 4 and 5) inside the STP 10 for performing field wiring in the STP 10 without breaching the hydraulic cavity 20 of the STP 10. The integral contractor box 29 is comprised of one or more plugs 32 that each contain an integral hexagon fastener 34 on top. Each of the plugs 32 are threaded as male connections underneath (not shown) such that they fasten with female threaded ports 37 (illustrated in FIG. 4 below) on the inside walls of the cavities 30. An o-ring is provided between the plugs 32 and the cavities 30 so that a fluid tight seal is made between the plugs 32 and the cavities 30 when the plugs 32 are screwed tightly into the female threads of the cavities 30. More detail about the integral contractor box 29 on the STP 10 is discussed below and illustrated in FIGS. 4 and 5, below.

The STP 10 also contains a check valve extraction housing 36 that allows extraction of a check valve 38 (illustrated in FIGS. 8-11, below) located in the manifold 19. The check valve extraction housing 36 is comprised of a lock down screw 92 (see FIG. 8) that is rotated clockwise to attach to the check valve 38 for extraction and depressurization of fuel inside the STP 10. The check valve 38 generally prevents fuel pumped by the STP 10 from the underground storage tank (not shown) from flowing back to the underground storage tank 10 and generally allows fuel to only flow in one direction within the STP 10. When the STP 10 is serviced, it is necessary to relieve the pressure differential between the inlet 86 and outlet side 88 (illustrated in FIG. 8, below) of the check valve 38 so that fuel inside the STP 10 is not pressurized when service personnel obtains access to the hydraulics cavity 90 by removing the check valve housing 36. More detail about the check valve extraction is discussed in more detail below and is illustrated in FIGS. 8-11, below.

The manifold 19 contains two siphon connections 42 that provide a siphon system. The siphon connections 42 are designed to receive a siphon cartridge 44 to provide coupling to a vacuum created inside the STP 10 via a nozzle 102 (illustrated in FIG. 12). In FIG. 1, only one siphon cartridge 44 is included. The other siphon connection 42 is unused and contains a dummy plug 46. The siphon system allows the STP 10 to generate a vacuum internally from fuel flow through a venturi to pull a separate vacuum on other systems as will be later described in this patent application.

Figure 2:
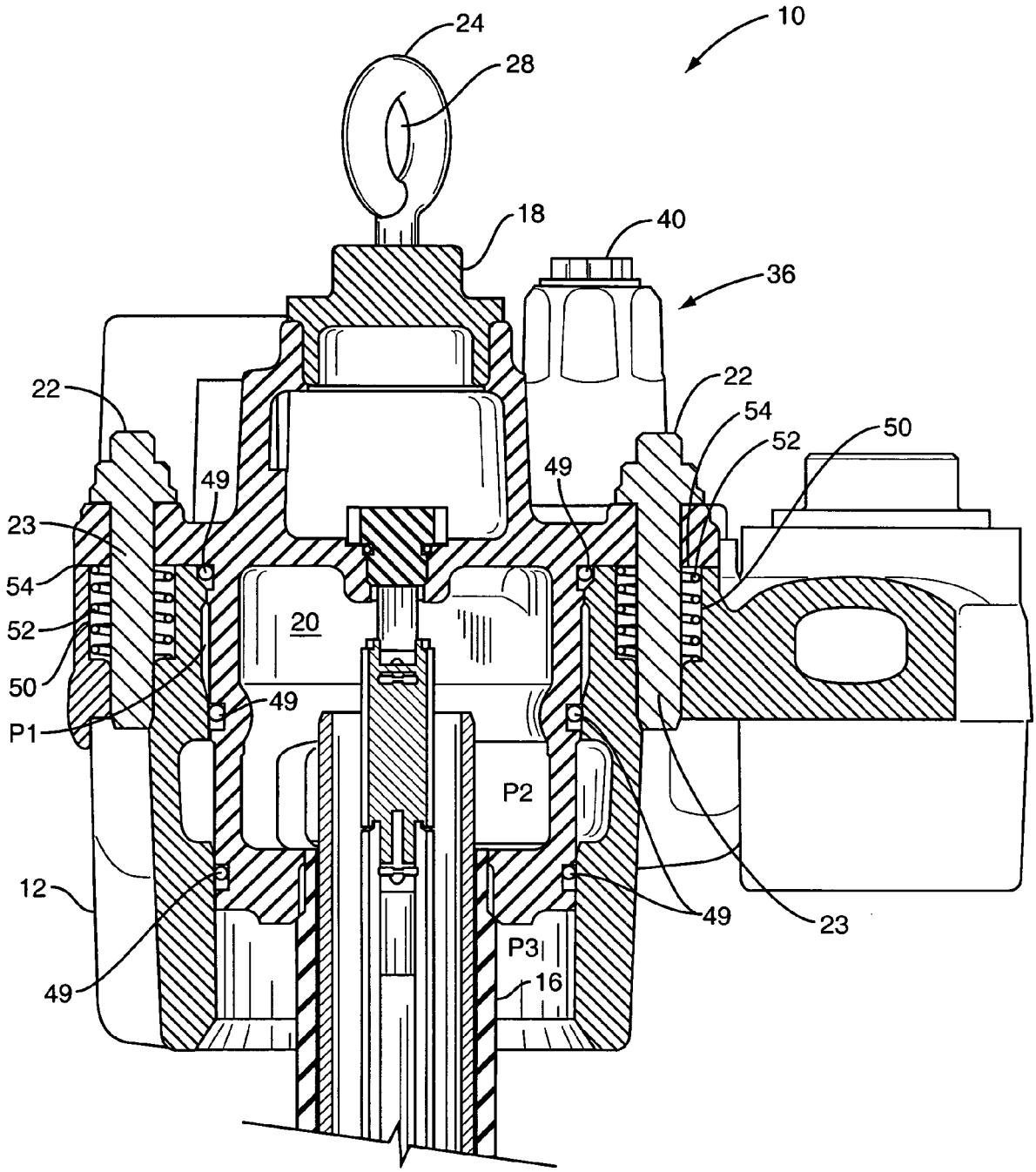
FIG. 2 is a cross sectional diagram of the STP illustrated in FIG. 1.

FIG. 2 illustrates a cross sectional view of the STP 10 illustrated in FIG. 1 to illustrate die springs 52 that are included in the manifold 19 of the STP 10. If the STP 10 is required to be serviced by service personnel, the service personnel may need to remove the packer 18 from the manifold 19 to access the hydraulic cavity 20 of the STP 10. Three sets of o-rings 49 are included between the packer 18 and the manifold 19 to provide sealing for three different pressure zones within the hydraulic cavity 20. Each of the three pressure zones are labeled as pressure zone 1 (P1), pressure zone 2 (P2), and pressure zone 3 (P3) in FIG. 2. Pressure zone 3 is at the same pressure as inside the underground storage tank (not shown). Pressure zone 2 is where the pump is developing pressure inside the fuel supply piping that is coupled to fuel dispensers and receives the fuel from the STP 10. Pressure zone 1 returns fuel from the nozzle 102 inside the STP 10 back to the underground storage tank.

After a while, the o-rings 49 swell when exposed to fuel inside the manifold 19 thereby increasing the friction between the packer 18 and the manifold 19 if separated. Before the present invention, this causes a great deal of force to have to be exerted on the handle 24 to remove the packer 18 from the manifold 19 to gain access to the hydraulic cavity 20.

In the present invention, the manifold 19 includes two female pockets 50 that are located directly beneath the nuts 22 that secure the packer 18 to the manifold 19. Die springs 52 are placed inside each of the two female pockets 50 while the packer 18 is removed during manufacturing or servicing of the STP 10. Springs 52 are selected so that the springs 52 extend beyond the top of upper plane 54 of the manifold 19 when not under any compression. When the packer 18 is placed on top of the manifold 19, and the nuts 22 are tightened to seal the packer 18 to the manifold 19, the springs 52 are compressed inside the pockets 50 causing the springs 52 to store energy. When service personnel desires to remove the packer 18 from the manifold 19, the service personnel applies a pulling force to the packer 18, usually via the handle 24 after the nuts 22 are loosened. The die springs 52, under compression, are exerting a force against the packer 18 so that less pulling force is required to be applied to the handle 24. In essence, as the packer 18 is pulled upward, the energy stored in the springs 52 is also exerting force upward against the packer 18 thereby aiding in the removal of the packer 18 from the manifold 19.

The inclusion of die springs 52 in the manifold 19 is an improvement over prior STP 10 designs that provide the ability to remove a packer 18 from the manifold 19. Depending on the springs 52 selected and the amount of energy stored in the springs 52 when compressed, when the packer 18 is sealed onto the manifold 19, the springs 52 may even contain enough stored energy to separate the packer 18 from the manifold 19 after the nuts 22 are loosened without any pulling force being applied on the handle 24. Before inclusion of the die springs 52, a larger amount of force had to be applied to the packer 18 to remove it from the manifold 19 especially since the o-ring seals 49 provide a pressurized seal between the packer 18 and the manifold 19 requiring high extraction/separation forces to remove the packer 18 from the manifold 19 for servicing.

Any type of spring may be used as the springs 52. Further, even though the current design of the STP 10 includes two springs 52, only one spring 52 and pocket 50 combination may be used, or more than two springs 52 and pocket 50 combinations may be used. It may be more advantageous to provide only one spring 52 for space conservation so long as a single spring 52 can store enough energy to aid in the extraction of the packer 18 from the manifold 19. According to one embodiment of the present invention, the springs 52 are Raymond® die springs manufactured by Associated Spring.

Figure 3:
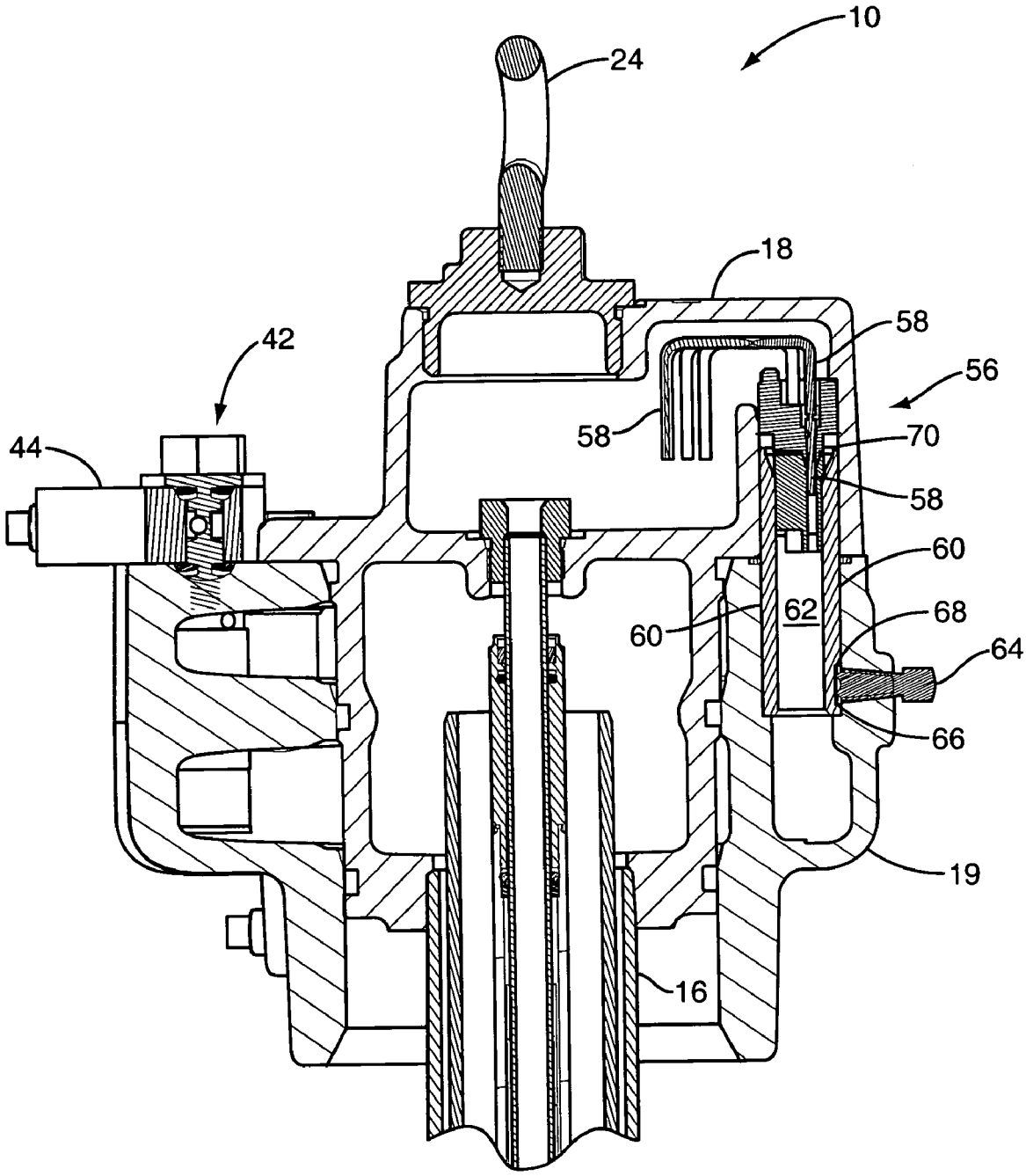
FIG. 3 is a schematic diagram of a yoke design integral to the manifold of the STP.

Another aspect of the STP 10 that is a subject of this application is an improved yoke assembly 56 illustrated in FIG. 3. An example of a yoke assembly in the prior art is illustrated and described in detail in FIGS. 3 and 10 of U.S. Pat. No. 6,223,765 B1, previously reference above.

Turning to FIG. 3, electrical wires 58 include electrical lead wires. The yoke assembly 56 design according to the present invention includes a yoke sleeve 60 that is an integral part of the manifold 19 unlike prior art systems where the yoke is a separate device that is bolted onto the packer 18. The yoke sleeve 60 is hollow and forms a conduit 62 for the electrical wires 58 that bring electricity from the STP 10 to the turbine pump inside the underground storage tank (not shown). The yoke sleeve 60 is held into place into the manifold 19 using a set screw 64 that is bored into the outer side of the manifold 19. The set screw 64 may extend outside of the manifold 12 and is designed to fit into a groove 66 located in the outer wall 68 of the yoke assembly 60. In another embodiment, the set screw 64 may be captive within the manifold 12 in which case the set screw 64 would not extend outside of the manifold 12. This may be desirable to prevent the potential for service personnel inadvertently failing to reinstall the set screw 64 after removal. Removal of the set screw 64 allows the yoke sleeve 60 to be removed if servicing and/or replacement of the yoke sleeve 60 is required. However, during normal operation and servicing, the yoke sleeve 60 is not removed and it forms an integral part of the manifold 19 unlike prior art STP systems.

It is necessary for safety reasons to ensure that the electrical wires 58 that connect to the turbine pump (not shown) are disconnected from the electrical wires 58 that run inside the conduit 62 in the yoke sleeve 60 if the packer 18 is removed from the manifold 19. When the packer 18 is removed, the electrical wires 58 are broken at the critical point 70. In prior art systems, the yoke assembly was a separate device from the STP 10, like in aforementioned U.S. Pat. No. 6,223,765 B1. The yoke was provided in an explosion proof housing in case a spark were to occur at the joint where an electrical connection is made between the yoke and packer. In this prior art system, service personnel had to first remove the yoke assembly separately before gaining access to the hydraulics cavity 20 to remove the pump via removal of the packer. Now with the present invention, service personnel only need to remove the packer 18 to automatically sever the electrical wires 58 when the packer 18 is removed from the manifold 19 since the yoke assembly 60 is integral with the manifold 19 and not the packer 18.

The STP 10 also contains an integral contractors box 29 comprised of one or more electrical cavities 30. In the example illustrated in FIG. 4, there is only one electrical cavity 30. This electrical cavity 30 is provided to provide access to field wires that are brought into the cavity 30 from underneath the STP 10 through the field wiring conduit 74 (illustrated in FIG. 5). The electrical cavity 30, when sealed, serves as an explosion proof area where field wiring connections can be made for the STP 10 for a device that contains a Class 1, Division 1 area due to fuel handling.

Figure 5:
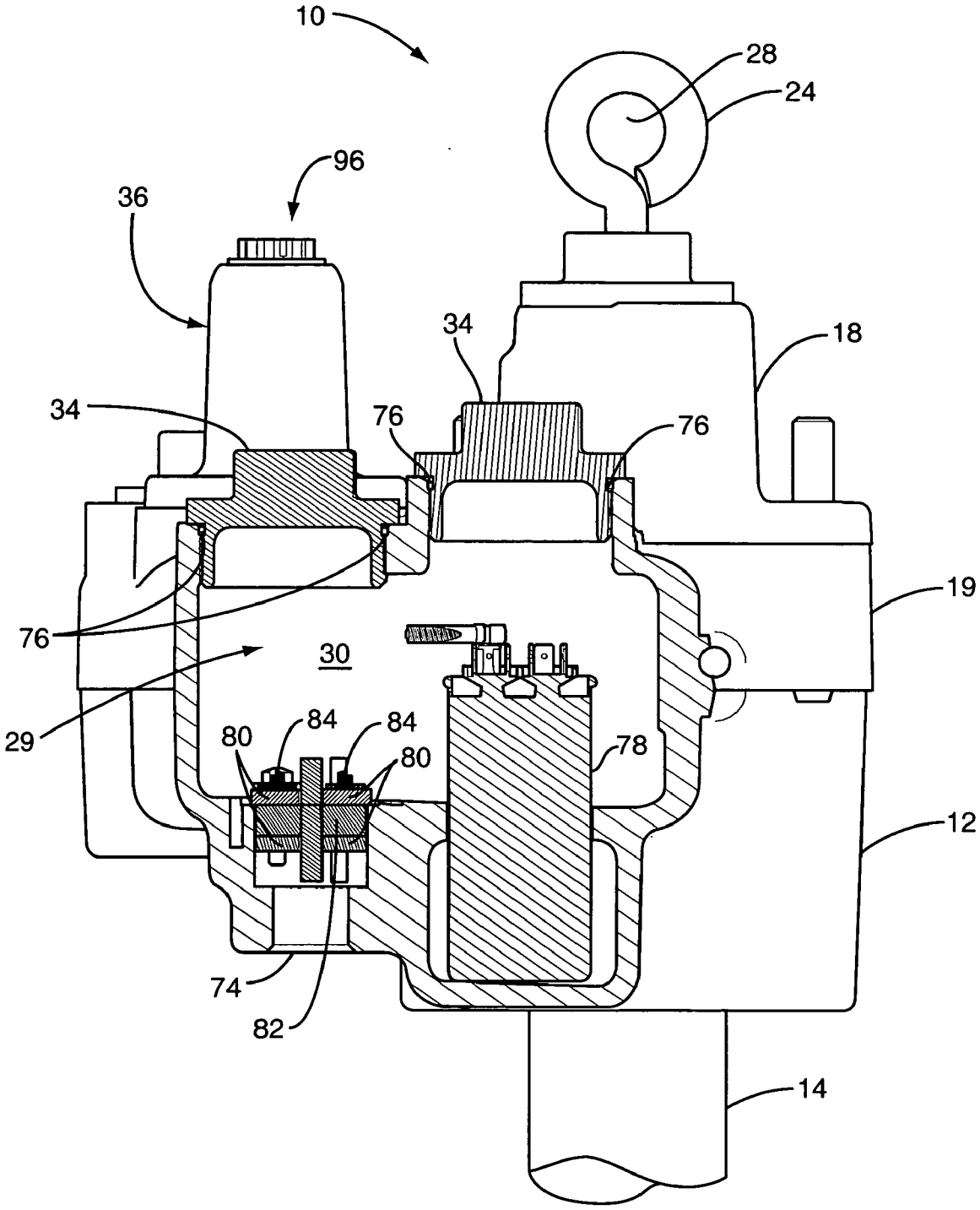
FIG. 5 is a schematic diagram of the electrical cavities inside the STP that are accessible via the electrical contractors box.

When service personnel make wiring connections necessary to put the STP 10 into service in the field, the service personnel bring the wiring into the electrical cavities 30 via the field wiring conduit 74 in FIG. 5. The pump wires that are connected to the turbine pump (not shown) come over from the yoke assembly 60. After the service personnel runs the field wiring into the field wiring conduit 74, a seal is made by placing a piece of rigid conduit in the field wiring conduit 74 to seal off the electrical cavities 30 from its environment including the underground storage tank and any vapors that may be proximate to the field wiring conduit 74. The field wiring is brought into the electrical cavity 30 by running the wiring through a rubber bushing 82 that is compressed between two steel plates 80 on the top and bottom of the rubber bushing 80. The screws 84 are tightened and the bushing is compressed to provide strain relief to the wiring in case the wiring is pulled from the field wiring conduit 74.

When service personnel later want to access the field wiring without breaking the seal formed at the field wiring conduit 74 underneath the manifold 19, the service personnel can loosen the plugs 34 to gain access to the electrical cavity 30. The plugs 34 seal the electrical cavity 30 off and o-rings 76 are provided between the plugs 34 and the threaded ports 37 to form a tight seal when the plugs 34 are tightened.

One reason that an electrical cavity 30 is provided that contains two plugs 34 for access in the STP 10 is that a capacitor 78 is included inside the electrical cavity 30 in this example. A capacitor 78 may be used to store energy to assist the motor (not shown) in the STP 10 when a fuel dispenser is activated to dispense fuel. Please note that the capacitor 78 is an optional component and is not required.

Figure 6:
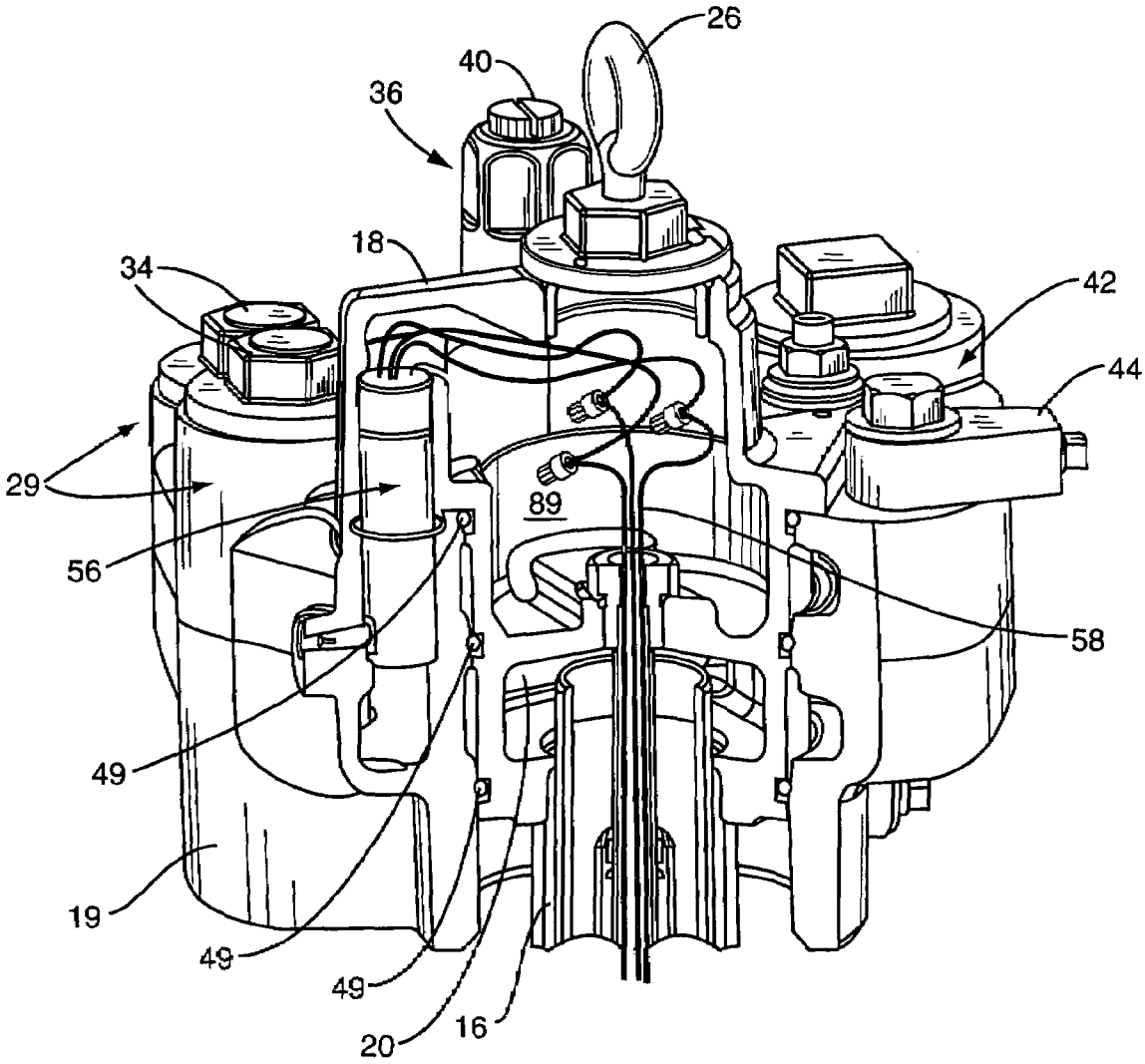
FIG. 6 is a schematic diagram illustrating electrical wiring passing into the yoke design of FIG. 3 from the turbine pump.
Figure 7:
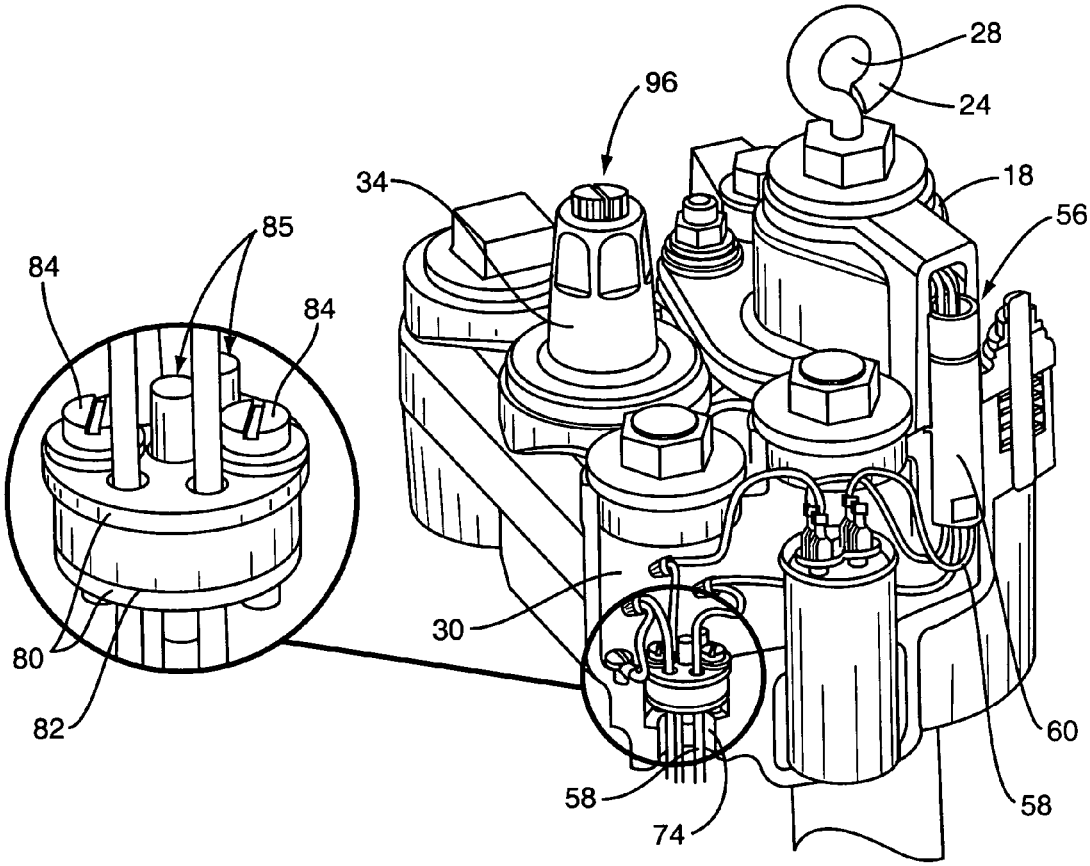
FIG. 7 is a schematic diagram illustrating the electrical wiring of FIG. 6 passing from the yoke design of FIG. 3 into the electrical cavities of FIG. 5.

FIG. 6 illustrates the flow of the electrical wiring 58 from the turbine pump within the UST (not shown) into an internal electrical cavity 89 within the packer 18. As shown, the electrical wiring 58 passes through an electrical conduit within the column pipe 16 into the internal electrical cavity 89. From the internal electrical cavity 89, the electrical wiring 58 passes through the yoke sleeve 60 of the yoke assembly 56. As illustrated in FIG. 7, from the yoke sleeve 60, the electrical wiring 58 passes into the electrical cavity 30 within the manifold 19 where it may optionally be connected to the capacitor 78. From the electrical cavity 30, the electrical wiring passes through the field wiring conduit 74 and may be connected to an external source, such as an external power source.

As discussed above, the rubber bushing 82 within the field wiring conduit 74 is compressed between the two steel plates 80 on the top and bottom of the rubber bushing 80. The screws 84 are tightened and the bushing 82 is compressed to provide strain relief to the electrical wiring 58. It should also be noted that the steel plates 80 have multiple holes through which individual wires of the electrical wiring 58 pass. As illustrated, the two steel plates 80 include five holes. Since there are only three wires in the electrical wiring 58, two of the holes are plugged by plugs 85.

Figure 8:
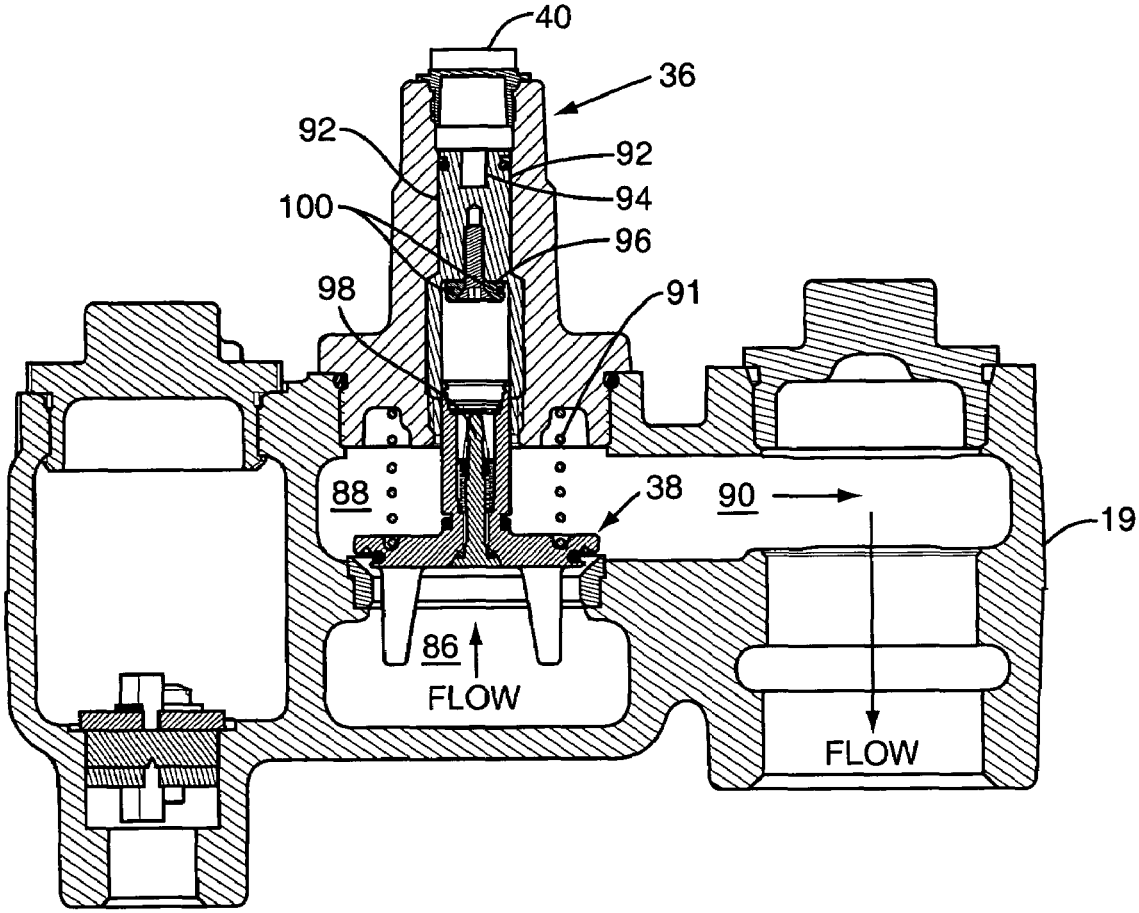
FIG. 8 is a schematic diagram of a check valve in the fuel piping inside the STP.

FIG. 8 illustrates another aspect of the present invention where a check valve 38 is provided in the hydraulics cavity 90 of the STP 10. The check valve 38 is provided in a check valve housing 36. As fuel is pumped from the turbine pump (not shown) through a column pipe 16 (not illustrated in FIG. 8) and into the STP 10, the fuel flow encounters the inlet side 86 of the check valve 38. The check valve 38 is designed so that fuel can flow from the inlet side 86 to the outlet side 88 of the check valve 38. The force exerted by the fuel flow pushes up on the check valve 38 on its inlet side 86 and allows fuel to flow around the outsides of the check valve 38 and through the hydraulic cavity 90 to the right of the check valve 38. The check valve 38 is biased to a closed position by a spring 91 and prevents fuel from back flowing to the underground storage tank.

When the STP 10 is serviced, the STP 10 is shut off and the service personnel must remove the packer 18 to pull out the pump in the hydraulic cavity 20 for servicing. However, after the STP 10 is turned off, there is still residual pressure trapped in the pipeline when the check valve 38 is closed since fuel will no longer flow to keep the check valve 38 opened. There is a differential pressure between the outlet side 88 of the check valve 38, which is hydraulic cavity 90, and atmosphere. If the check valve housing 36 is removed by service personnel to gain access to the check valve 38, the pressure build up on the outlet side 88 of the check valve 38 will equalize with atmosphere (or the pressure on the outside the STP 10) and fuel will possibly spill outside of the manifold 19 and STP 10 to the environment and possibly make contact with the service personnel. The present invention provides the ability to depressurize the outlet side 88 of the check valve 38 before the check valve 38 is serviced by actuation of a lock down screw 92, which has not been done before the present invention.

Depressurization of the check valve 38 is accomplished by placing a tool inside receptacle 94 and rotating the receptacle 94 which lowers the lock down screw 92 on the check valve stem 98 illustrated in FIG. 8. Specifically, it is the c-spring retainer 96 as part of the lock down screw 92 that engages the check valve stem 98.

Figure 9:
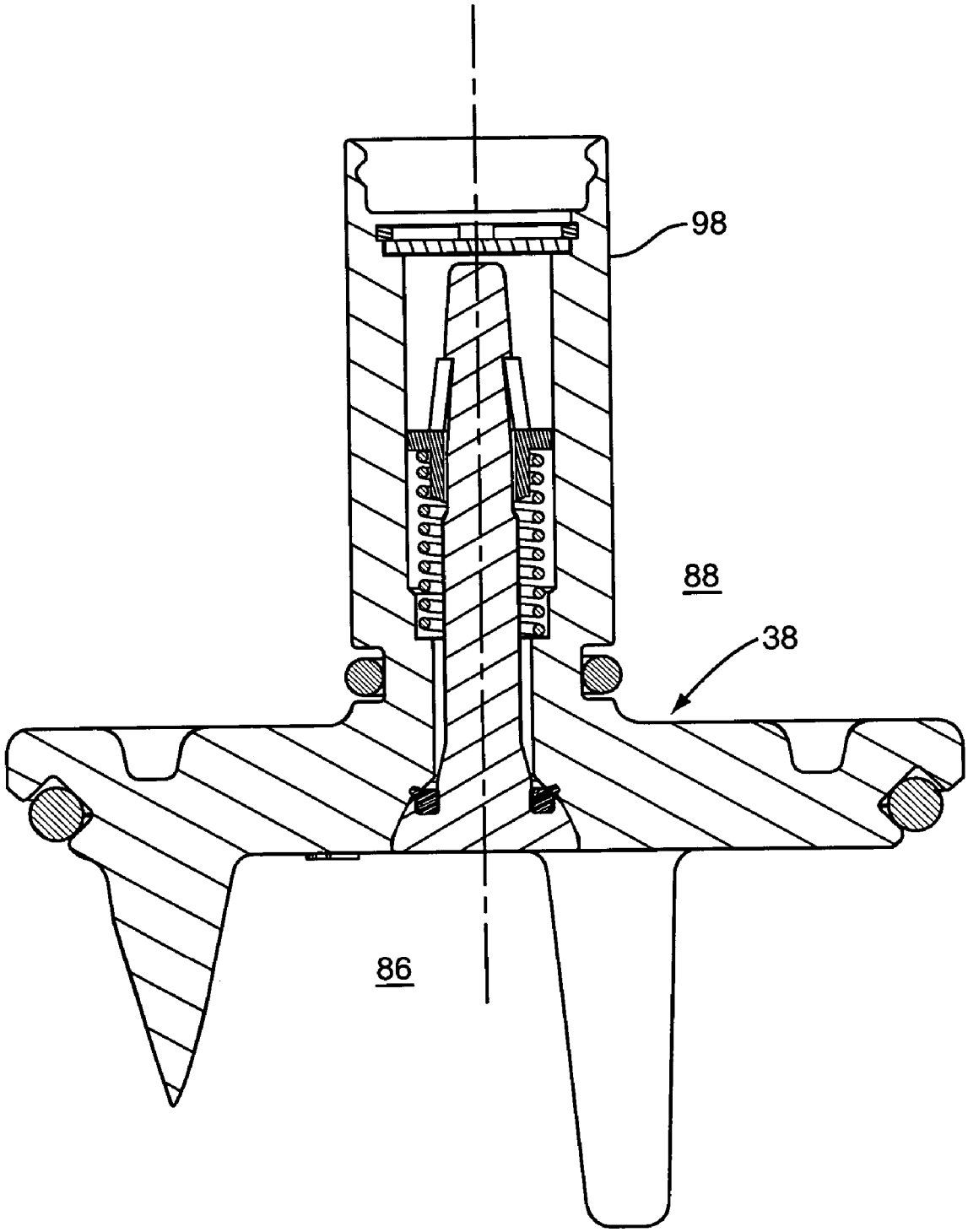
FIG. 9 is a more detailed schematic diagram of the check valve illustrated in FIG. 6 and a c-spring extraction device.

FIG. 9 illustrates a more detailed view of the check valve 38 and how the present invention provides for depressurization of the check valve 38. The c-spring retainer 96 contains a c-spring 100 that grabs onto the stem 98 of the check valve 38 and forms a secure fit to the stem 98. After the lock down screw 92 is fully engaged, the screw 92 can be rotationally reversed to pull up on the stem 98 of the check valve 38. This pulls up the check valve 38 and couples the inlet side 86 to the outlet side 88 of the check valve 38 together so that the pressure between the two sides equalizes and pressure on fuel contained on the outlet side 88 of the check valve 38 is relieved.

The lock down screw 92 also allows the check valve 38 to be locked into position when fuel supply piping is checked for leaks during installation and on service calls. When the check valve 38 is locked into a closed position, the STP 10 effectively cannot release pressure. This effectively isolates the STP 10 from the fuel supply piping that connects the STP 10 to the fuel dispensers for delivery of fuel. It may be desired for service personnel to pressurize and test the fuel supply piping to ensure that no leaks are present. With the present invention, service personnel can use the STP 10 to lock down the check valve 38 to isolate the STP 10 from the fuel supply piping. In this manner, if a leak is detected when pressurizing and testing the fuel supply piping for leaks, the STP 10 can be eliminated as the source of the leak since it is isolated from the fuel supply piping.

Figure 10:
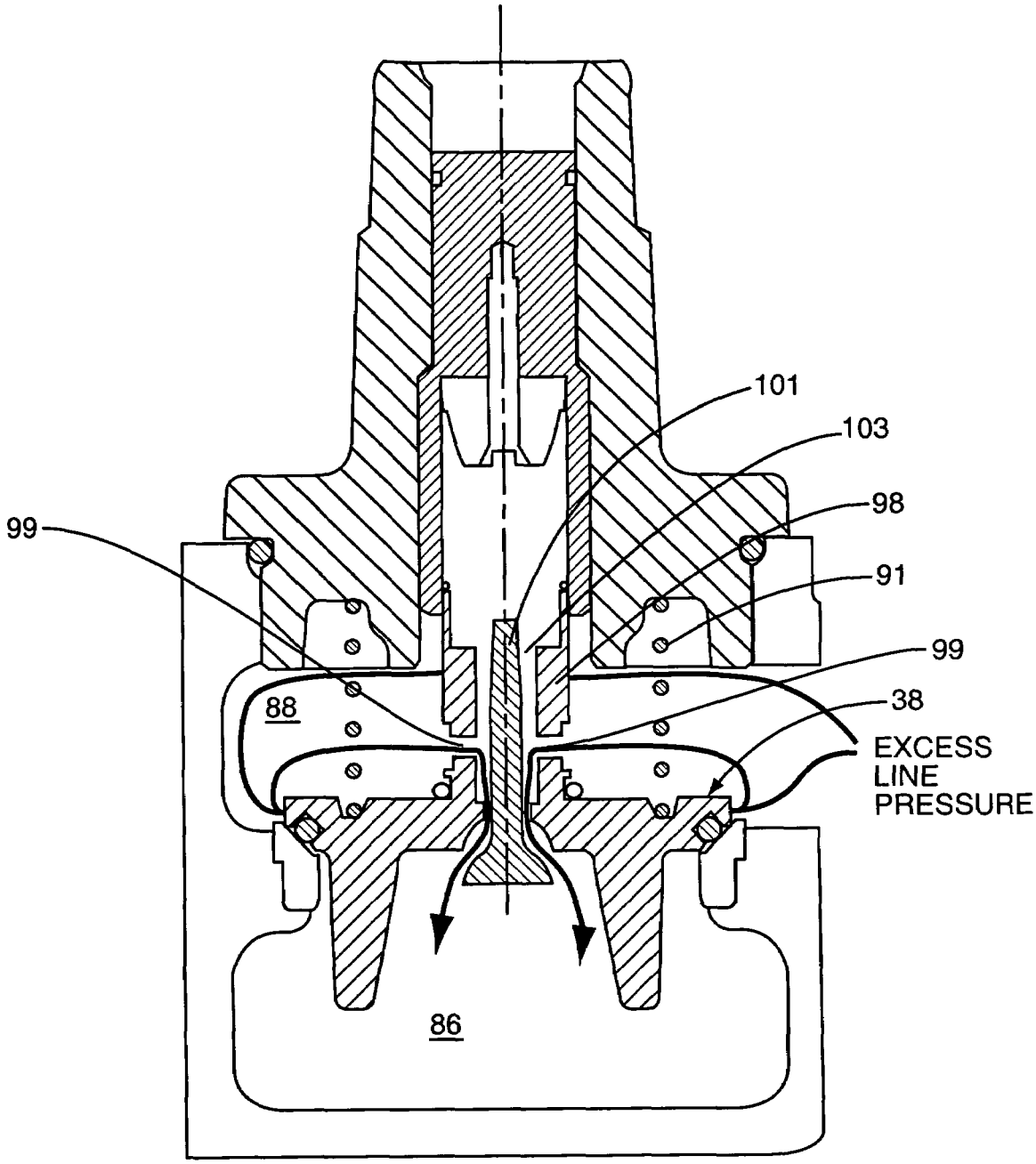
FIG. 10 is a schematic diagram of a second embodiment of check valve of FIGS. 8 and 9.

FIG. 10 illustrates a second embodiment of check valve 38 of FIGS. 8 and 9. In this embodiment, the check valve 38 includes one or more passages 99 through the check valve stem 98 that couple the outlet side 88 of the check valve 38 and thus the hydraulic cavity 90 (FIG. 8) to an internal chamber 103 within the check valve stem 98. When the turbine pump is off, pressure at the outlet side 88 may increase due to vapor expansion. When the pressure increases to a predetermined threshold, the pressure forces a check valve 101 within the check valve stem 98 open, or downward, such that a passage is created between the outlet side 88 and the inlet side 86 of the check valve 38 and excess pressure is relieved. Once the pressure drops below the predetermined threshold, the check valve 101 within the check valve stem 98 moves upward, thereby sealing the passage through the check valve stem 98 between the outlet side 88 and the inlet side 86 of the check valve 38.

Figure 11:
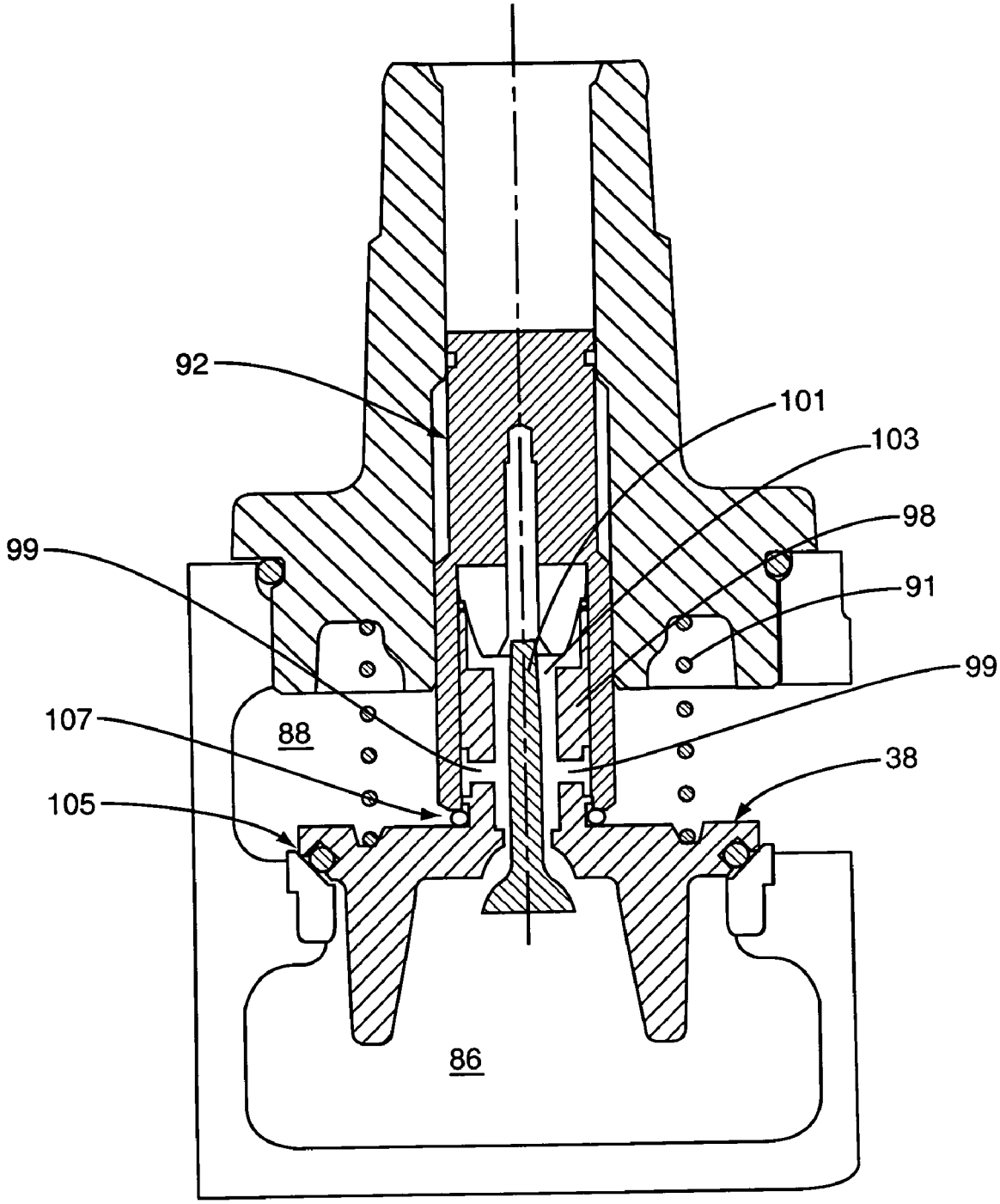
FIG. 11 is a schematic diagram of the check valve of FIG. 10 illustrating the check valve in a locked-down state.

FIG. 11 illustrates the check valve 38 of FIG. 10 in a locked-down state. As discussed above, the lock down screw 92 allows the check valve 38 to be locked into position when fuel supply piping is checked for leaks during installation and on service calls. In this embodiment, when the lock down screw 92 is rotated downward, the lock down screw 92 comes to rest against the check valve 38, thereby locking the check valve 38 in a closed position. In doing so, the lock down screw 92 forces the check valve 38 into a closed position such that the inlet side 86 is sealed from the outlet side 88 by an o-ring 105. When in this position, the lock down screw 92 also seals the passages 98 in the check valve 38 using o-ring 107 such that the passage between the outlet side 88 and the inlet side 86 of the check valve 38 discussed with respect to FIG. 10 is also sealed.

Figure 12:
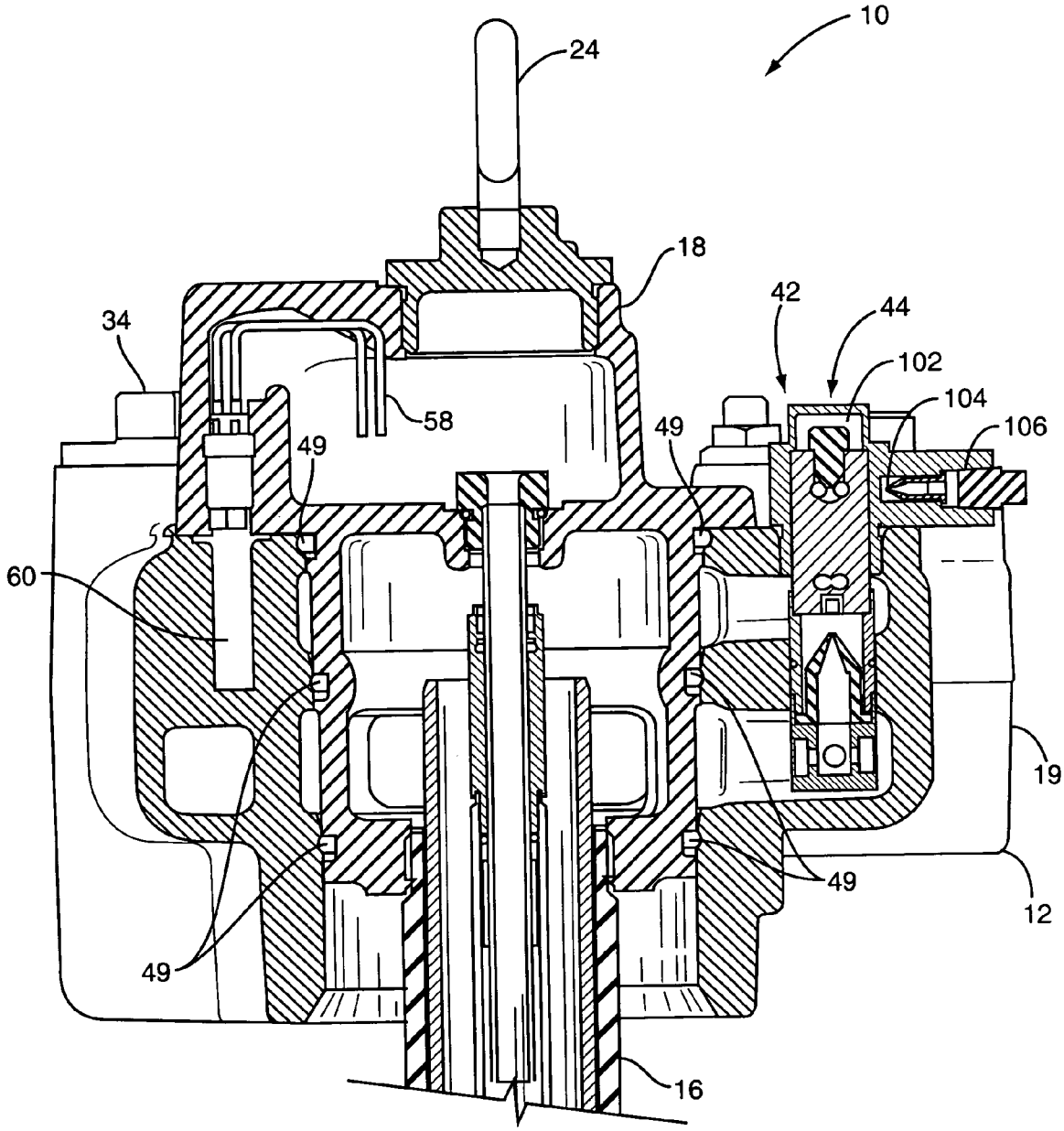
FIG. 12 is a schematic diagram of a nozzle in the STP that is used to generate an external vacuum source siphon.
Figure 13:
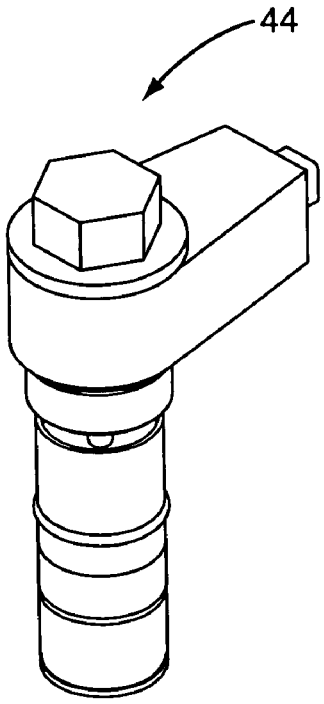
FIG. 13 is a schematic diagram of the siphon cartridge designed to couple to a siphon connection.
Figure 13:
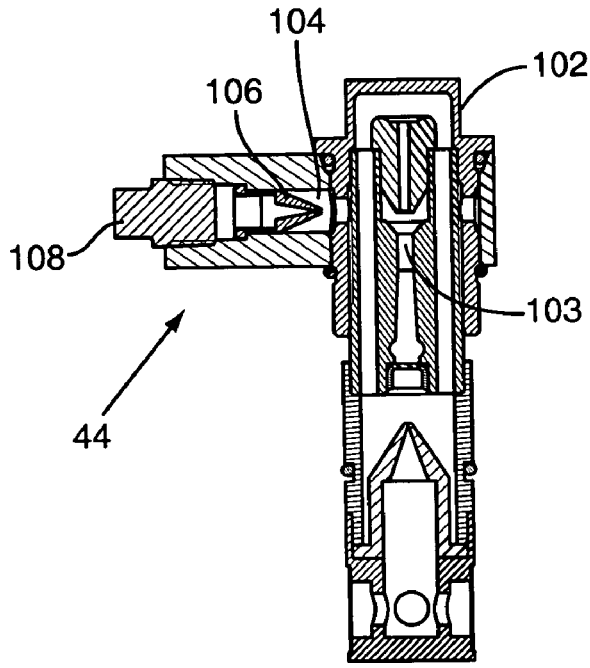

FIGS. 12-13 illustrate another aspect of the present invention relating to a siphon system. In FIG. 12, siphon cartridge 44 is shown as being installed in the manifold 19. The siphon cartridge 44 is comprised of a nozzle 102. The nozzle 102 directs fuel from the STP 10 when the siphon cartridge 44 is installed through a venturi 103 (illustrated in FIG. 13) and a vacuum is created as a result in a chamber 104 perpendicular to the axis of the nozzle 102. This vacuum can be applied against other components and systems independent of the STP 10 for purposes that will be described herein. The siphon cartridge 44 contains a check valve 106 that maintains vacuum in whatever component is connected to the siphon connection 42 when the pump is de-energized. Thus, when the pump is de-energized, the pressure in the chamber 104 returns to the pressure that is resident in zone P1, and check valve 106 operates to maintain the vacuum in whatever component is connected to the siphon connection 42.

FIG. 13 illustrates a more detailed view of siphon cartridge 44. Once the siphon cartridge 44 is connected to the siphon connection 42, the check valve 106 is forced to be opened and the chamber 104 is fluidly coupled to whatever component is connected to the siphon cartridge at connection point 108. The siphon cartridge 44 is designed to be inserted into the manifold 19 of the STP 10 so that a service personnel can simply connect a siphon cartridge 44 to a siphon connection 42 to use the STP 10 to generated a vacuum inside the nozzle 102. The STP 10 illustrated in the drawings contains two siphon connections 42, but the STP 10 could only contain only one siphon connection 42 or could contain more than two siphon connections 42, which is simply a design choice. If the siphon connection 42 is not to be used, a dummy plug 46 illustrated in FIG. 1 can be used to seal up the siphon connection 42.

The vacuum created by the siphon connection cartridge 44 may be used for a number of purposes. For instance, the vacuum may be used to siphon two underground storage tanks together, as is shown and described in U.S. Pat. No. 5,544,518 entitled "Apparatus and Method for Calibrating Manifolded Tanks," incorporated herein by reference in its entirety. The vacuum may also be used to generate a vacuum in a defined space for leak detection purposes. For example, pending patent application Ser. Nos. 10/238,822 entitled "Secondary Containment System and Method;" Ser. No. 10/430,890 entitled "Secondary Containment Leak Prevention and Detection System and Method;" and Ser. No. 10/390,346 entitled "Fuel Storage Tank Leak Prevention and Detection," all of which are incorporated herein by reference herein in their entireties, and disclose pressure monitoring and leak detection systems where a vacuum generated by the STP 10 is used to generate a vacuum in an interstitial space, including but not limited to a double-walled underground storage tank interstitial space, the interstitial space of double-walled fuel piping.

Those skilled in the art will recognize improvements and modifications to the preferred embodiments of the present invention. All such improvements and modifications are considered within the scope of the concepts disclosed herein and the claims that follow.

What is claimed is:

1. A submersible turbine pump, comprising:

a casing body, comprising:

a check valve extraction housing; and a hydraulics cavity; and a check valve located within the hydraulics cavity comprising a check valve stem, an inlet side, and an outlet side, wherein fuel flowing in the submersible turbine pump applies a force to the inlet side, thereby opening the check valve and allowing the fuel to flow from the inlet side to the outlet side;

the check valve extraction housing comprising a lock-down screw adapted to attach to the check valve stem when rotated in a first direction and apply a force on the check valve stem when rotated in a second direction to open the check valve, thereby relieving a pressure differential between the inlet side and the outlet side.

2. The submersible turbine pump of claim 1 wherein the lock-down screw is lowered when rotated in the first direction and further comprises a c-spring that attaches the lock-down screw to the check valve stem when the lock-down screw is lowered to engage the check valve stem.

3. The submersible turbine pump of claim 2 wherein the lock-down screw is further adapted to be rotationally reversed when rotated in the second direction, thereby opening the check valve.

4. The submersible turbine pump of claim 1 wherein the lock-down screw is further adapted to be rotationally reversed when rotated in the second direction, thereby opening the check valve.

5. The submersible turbine pump of claim 1 wherein the lock-down screw is further adapted to be forwardly rotated such that the lock-down screw engages the check valve stem and locks the check valve in a closed position.

6. The submersible turbine pump of claim 1 wherein the check valve stem comprises:

a passage coupling the outlet side of the check valve to an internal chamber within the check valve stem; and an internal check valve separating the internal chamber within the check valve stem from the inlet side of the check valve such that when the check valve is closed and a pressure at the outlet side of the check valve exceeds a predetermined threshold, the internal check valve is forced to an open position, thereby coupling the outlet side of the check valve to the inlet side of the check valve.

7. The submersible turbine pump of claim 6 wherein the lock-down screw engages the check valve stem such that the check valve is locked in a closed position and the passage coupling the outlet side of the check valve to the internal chamber within the check valve stem is sealed when the lock-down screw is forwardly rotated.

8. A method of relieving a pressure differential between an inlet side and an outlet side of a check valve in a submersible turbine pump, comprising:

rotating a lock-down screw in a check valve extraction housing in a first direction to attach the lock-down screw to a check valve stem of the check valve within a hydraulics cavity of the submersible turbine pump;

applying a force on the check valve stem by further rotating the lock-down screw in a second direction; and opening the check valve using the force to couple the inlet side of the check valve to the outlet side of the check valve to relieve pressure between the inlet side and the outlet side of the check valve.

9. The method of claim 8 wherein the rotating step further comprises:

lowering the lock-down screw onto the check valve stem; and engaging the check valve stem via a c-spring, thereby attaching the lock-down screw to the check valve stem.

10. The method of claim 9 wherein the applying a force step further comprises reversibly rotating the lock-down screw, thereby pulling the valve stem.

11. The method of claim 8 wherein the applying a force step further comprises reversibly rotating the lock-down screw, thereby pulling the valve stem.

12. The method of claim 8 wherein the rotating, applying, and opening steps are effectuated when the submersible turbine pump is inactive.

13. A method of testing fuel supply piping for leaks, comprising:

isolating a submersible turbine pump from the fuel supply piping, the isolating step comprising:

rotating a lock-down screw in a check valve extraction housing of the submersible turbine pump to attach the lock-down screw to a check valve stem of a check valve within a hydraulics cavity of the submersible turbine pump;

applying a force on the check valve stem; and forcing the check valve in a closed position, thereby isolating the submersible turbine pump from the fuel supply piping; and pressurizing the fuel supply piping.

14. The method of claim 13 wherein the rotating step further comprises:

lowering the lock-down screw having a c-spring onto the check valve stem; and attaching the c-spring to the check valve stem, thereby attaching the lock-down screw to the check valve stem.

15. The method of claim 13 wherein the applying a force step further comprises forwardly rotating the lock-down screw, thereby pushing the check valve stem.

16. The method of claim 13 further comprising detecting leaks in the fuel supply piping.

17. The method of claim 13 wherein rotating the lock-down screw further comprises forwardly rotating the lock-down screw to engage the check valve stem.

* * * * *